US006506029B1

(12) United States Patent
Reichenmiller

(10) Patent No.: US 6,506,029 B1
(45) Date of Patent: Jan. 14, 2003

(54) GEAR PUMP

(75) Inventor: Michael Reichenmiller, Waldstetten (DE)

(73) Assignee: ZF Lenksysteme GmbH, Schwaebisch Gmuend (DE)

( * ) Notice: Subject to any disclaimer, the term of this patent is extended or adjusted under 35 U.S.C. 154(b) by 0 days.

(21) Appl. No.: 09/744,736

(22) PCT Filed: Jul. 17, 1999

(86) PCT No.: PCT/EP99/05121

§ 371 (c)(1),
(2), (4) Date: Jan. 24, 2001

(87) PCT Pub. No.: WO00/05504

PCT Pub. Date: Feb. 3, 2000

(30) Foreign Application Priority Data

Jul. 24, 1998 (DE) ..... 198 33 372

(51) Int. Cl.[7] ..... F04B 53/16; F04B 39/12

(52) U.S. Cl. ..... 417/313; 417/312; 418/181; 418/206.4; 181/241; 181/264

(58) Field of Search ..... 417/312, 313, 417/410.4; 181/200, 241, 264; 418/181, 206.1, 206.4

(56) References Cited

U.S. PATENT DOCUMENTS

| | | | | | |
|---|---|---|---|---|---|
| 4,174,196 | A | * | 11/1979 | Mori et al. | 418/9 |
| 4,265,267 | A | * | 5/1981 | Cyphelly | 137/117 |
| 4,486,160 | A | * | 12/1984 | Lipscombe | 419/205 |
| 4,752,195 | A | * | 6/1988 | Friedrich et al. | 417/540 |
| 5,411,376 | A | * | 5/1995 | Fournier et al. | 417/312 |
| 5,810,568 | A | * | 9/1998 | Whitefield et al. | 417/423.8 |
| 6,004,119 | A | * | 12/1999 | Hamasaki et al. | 418/181 |
| 6,048,187 | A | * | 4/2000 | Hamasaki et al. | 418/206.1 |

FOREIGN PATENT DOCUMENTS

| | | | |
|---|---|---|---|
| DE | 36 23 421 | | 1/1988 |
| DE | 41 20 757 | A1 * | 6/1991 |
| DE | 41 20 757 | | 1/1992 |
| DE | 43 08 452 | | 9/1994 |
| DE | 195 24 965 | | 1/1997 |
| DE | 195 33 215 | | 3/1997 |
| DE | 196 04 517 | | 8/1997 |
| DE | 196 27 668 | | 1/1998 |
| DE | 196 35 801 | | 3/1998 |
| EP | 0 748 939 | | 12/1996 |
| EP | 0 761 970 | | 3/1997 |

* cited by examiner

*Primary Examiner*—Charles G. Freay
*Assistant Examiner*—Han L. Liu
(74) *Attorney, Agent, or Firm*—Kenyon & Kenyon

(57) ABSTRACT

A gear pump for the power steering of a motor vehicle is integrated into the housing of the drive unit and is surrounded by both the discharge space and the intake space, which extend over the entire length of the housing Ribs are provided in the discharge space for pulsation damping and for stabilization of the pressure field. A filter space is provided between the cover and a filter cap.

24 Claims, 2 Drawing Sheets

GEAR PUMP

FIELD OF THE INVENTION

The present invention relates to a gear pump, in particular a power steering pump for the drive unit of a motor vehicle connected to a drive.

BACKGROUND INFORMATION

Gear pumps are used in a variety of ways in modern vehicles. For example, German Published Patent Application No. 196 04 517 describes a gear pump which is used in particular for power shift transmissions in motor vehicles and in which two intermeshing gear wheels are rotatably mounted in a pump housing. Between a suction kidney and a pressure kidney there is an area in which tooth chambers located between the teeth of the gear wheels are mutually sealed by a housing contour surrounding the gear wheels. A resupply device is provided for the gear pump, so that oil under pressure can be supplied through this at least one tooth chamber, which is separated from the suction kidney and pressure kidney in the direction of rotation. The tooth chambers which were not filled completely are thus refilled so that cavitation is prevented.

German Published Patent Application No. 195 33 215 describes a gear pump for the drive unit of a power steering system of a motor vehicle, having a pump housing accommodating two intermeshing gear wheels, each rotatably mounted on a shaft and having a shaft which leads out of the pump housing and is connected to the drive unit. At least one speed reduction step is provided in the drive connection between the gear pump and the drive unit. Noise suppression is achieved because of the reduction of the high rpm of the drive shaft to the low rpm of the gear pump. However, this gear pump still has a relatively large installed volume.

One object of the present invention is to provide a gear pump which can be used in particular as a power steering pump, has a simplified design and thus a small installed volume in combination with lower production costs and also offers the possibility of simple break-in on the test bench.

SUMMARY

The above and other beneficial objects of the present invention are achieved by providing a gear pump as described herein.

Integration of the gear pump and the discharge space in the housing as well as the cover on the attached oil container result in an especially small installed volume and a very simple design.

The partitioned intake space guarantees smooth oil supply, thus reducing the noise generated.

The return flow opens into the attached oil tank, and the pressure limiting valve in the cover sprays from the discharge space into the oil tank, so that the pressure limiting valve may be blocked when breaking in the gear pump on a test bench.

The central transverse bore composed of pressure bores in the discharge space and in the gear pump and a coaxial intake bore outside the center of the pump is drilled at the height of the gland, so that the advantage of symmetrical intake through the bore and slot from the partitioned intake space is achieved, and furthermore, pulsation is reduced due to the deflection of the oil stream on the pressure side.

DETAILED DESCRIPTION

Figure 1:
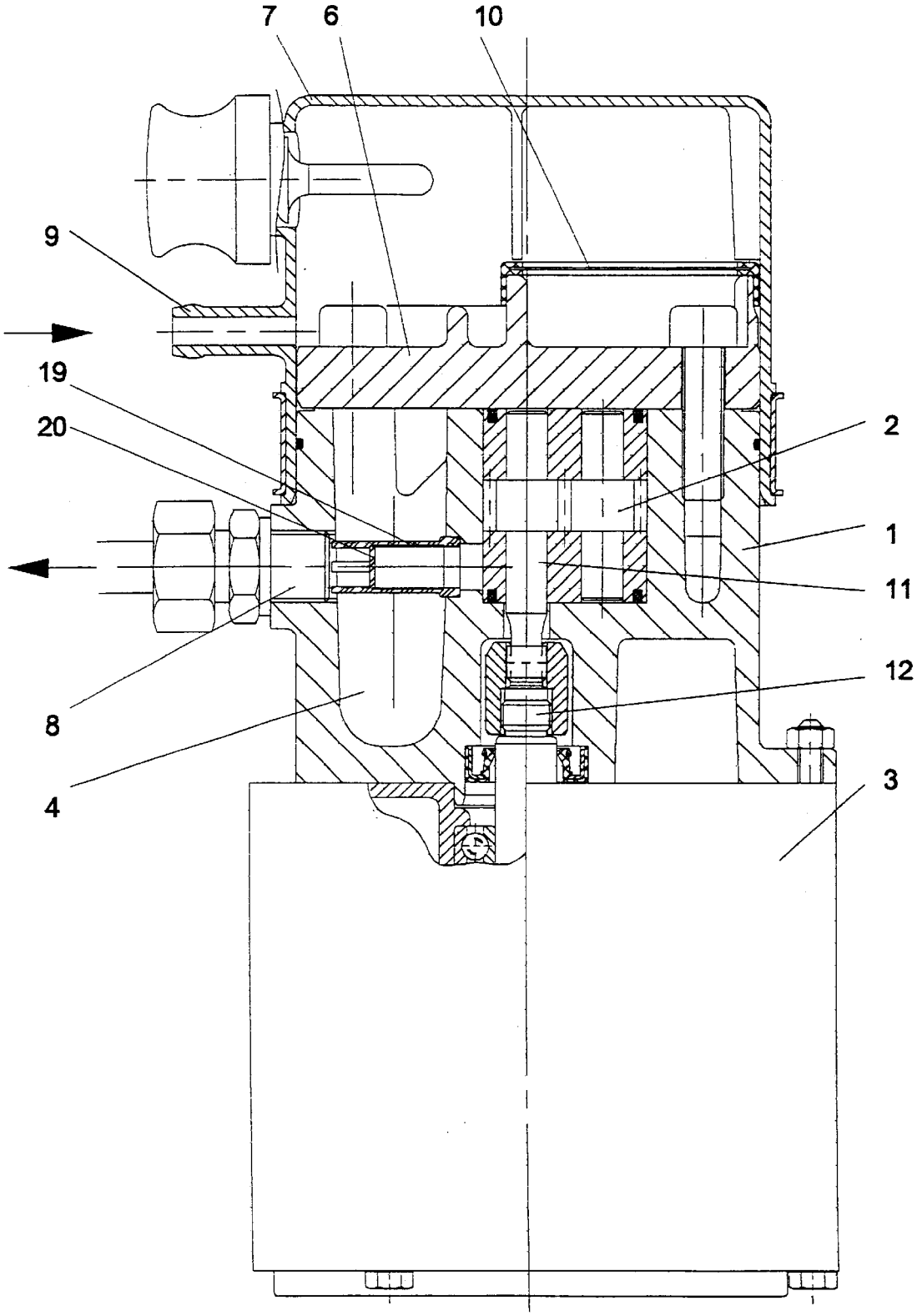
FIG. 1 is a cross-sectional view of a housing having a gear pump according to the present invention inserted therein.

The same parts in the Figures are labeled with the same reference numbers. Gear pump 2 is integrated into housing 1. A suitable drive 3, e.g., an electric motor, is bolted to housing 1. Furthermore, a discharge space 4 and a partitioned intake space 5 are provided in the, e.g., cylindrical, housing, gear pump 2 being surrounded by discharge space 4 and intake space 5. Discharge space 4 encompasses gear pump 2 on the circumference approximately as far as the inner pressure field of the gear pump and extends over the entire length of the housing.

Figure 2:
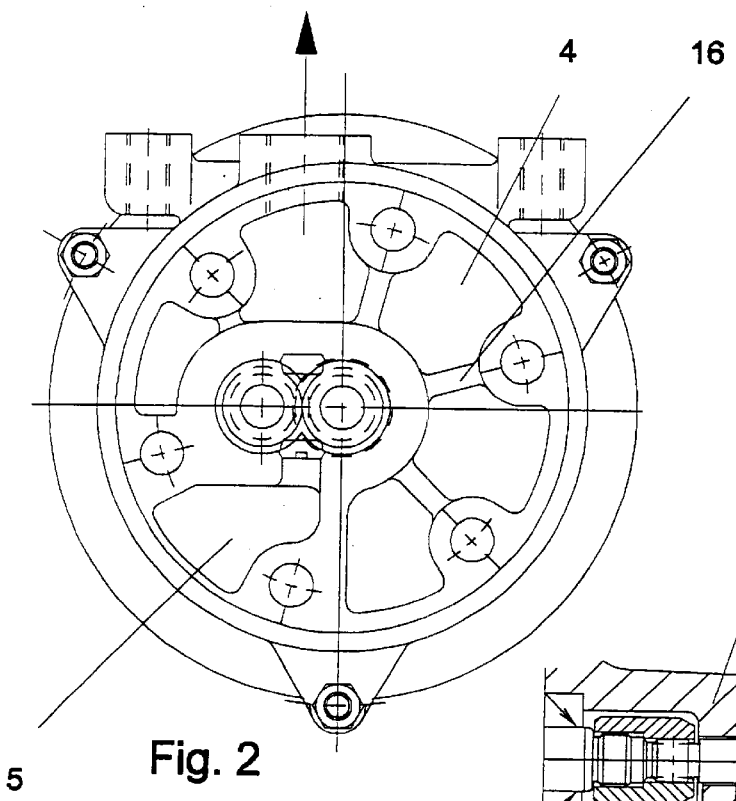
FIG. 2 is a front view thereof.

Furthermore, ribs 16 (FIG. 2) are provided in discharge space 4 for pulsation dampening and for stabilization of the pressure field.

Gear pump 2 draws in oil from an attached oil tank 7. A cover 6, an oil drain 8 and oil feed 9, i.e., the return flow, are also provided.

The intake side is subdivided into intake space 5 in housing 1, a filter space 17 and the volume of oil tank 7.

Partitioned intake space 5 guarantees smooth oil supply, with the return flow and the oil flows being swirled in the residual volumes through valves, which are not described in greater detail, outside the partitioned intake space.

Like discharge space 4, intake space 5 runs over the entire length of the housing, so, that the attached container volume, i.e., oil tank 7, may be smaller.

Filter space 17 is enclosed between cover 6 and a filter cap 10, but it is separate from intake space 5.

A feeder valve to discharge space 4 opens into filter space 17. Filter cap 10, shown only in cross section, is designed to be sealingly attached to the rib contour in the cover. The cover bolts are arranged inside the filter. The filter may therefore be removed when breaking in gear pump 2 on a test bench.

Oil feed 9 opens into attached oil tank 7, with a pressure limiting valve being provided in cover 6 to spray oil from discharge space 4 into oil tank 7, so that the pressure limiting valve may be blocked when breaking in gear pump 2 on a test bench.

Figure 4:
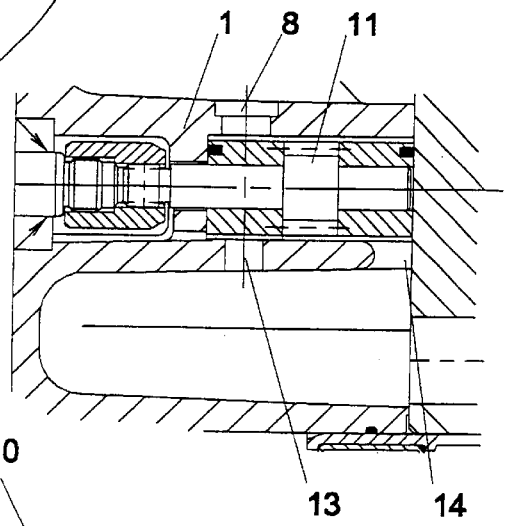
FIG. 4 is a cross-sectional view of a second embodiment thereof.

Gear pump 2 has a drive shaft 11, a clutch 12, an intake bore 13 (FIG. 4), a slot 14 and a gland 15.

A central transverse bore composed of pressure bores in the discharge space and in the gear pump and the coaxial intake bore 13 is provided at the level of the gland outside the center of the pump. There is therefore symmetrical intake of oil through the bore and slot 14 from partitioned intake space. Pulsation is reduced due to the additional deflection of the oil flow on the pressure side.

A pressure filter 19 is clamped into the central transverse bore between the discharge space and the gear pump on the pressure side. This pressure filter 19 contains a baffle 20, so that the oil coming in a pulsating flow from gear pump 2 is deflected into discharge space 4 and only then can it flow from housing 1 out of the discharge space. Pressure filter 19 is inserted through the pressure bore into housing 1 and clamped there.

Figure 3:
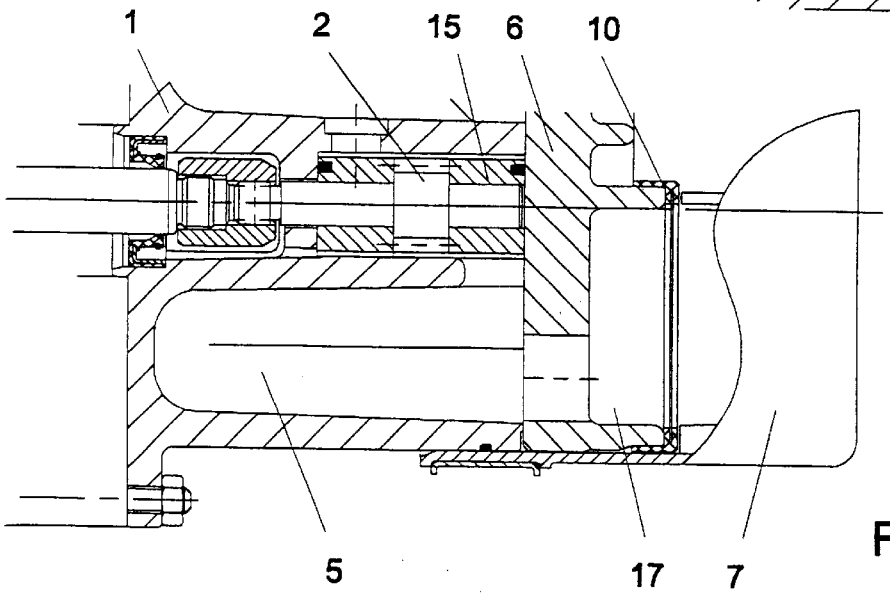
FIG. 3 is another cross-sectional view thereof.

Clutch 12 is loss-proof in assembly because of clutch lock 18 provided (FIG. 3).

What is claimed is:

1. A pump unit, comprising:

a housing;

a gear pump integrated into the housing;

a drive connected to the gear pump;

a discharge space extending radially to an outer limit of a pressure field of the gear pump and extending axially an entire length of the housing;

an intake space extending axially the entire length of the housing, the gear pump being surrounded by the discharge space and the intake space;

an oil feed; and an oil drain;

wherein the discharge space includes ribs arranged for pulsation damping and pressure field stabilization.

2. The pump unit according to claim 1, wherein the pump unit is a power steering pump for a drive unit of a motor vehicle.

3. The pump unit according to claim 1, further comprising a cover, a filter cap and a filter space disposed between the cover and the filter cap.

4. The pump unit according to claim 3, wherein the cover includes a pressure limiting valve.

5. The pump unit according to claim 1, wherein the oil feed is in fluid communication with an oil tank.

6. A pump unit, comprising:

a housing;

a gear pump integrated into the housing;

a drive connected to the gear pump;

a discharge space extending radially to an outer limit of a pressure field of the gear pump and extending axially an entire length of the housing, the discharge space including ribs arranged for pulsation damping and pressure field stabilization;

an intake space extending axially the entire length of the housing, the gear pump surrounded by the discharge space and the intake space;

an oil feed;

an oil drain;

a cover, a filter cap;

a filter space disposed between the cover and the filter cap; and a feeder valve for the discharge space in fluid communication with the filter space.

7. A pump unit, comprising:

a housing;

a gear pump integrated into the housing;

a drive connected to the gear pump;

a discharge space extending radially to an outer limit of a pressure field of the gear pump and extending axially an entire length of the housing;

an intake space extending axially the entire length of the housing, the gear pump being surrounded by the discharge space and the intake space;

an oil feed; and an oil drain;

wherein the discharge space includes ribs arranged for pulsation damping and pressure field stabilization; and wherein a central transverse bore having pressure bores in the discharge space is arranged coaxially in the gear pump.

8. The pump unit according to claim 7, wherein the central transverse bore includes a coaxial intake bore disposed at a level of a gland located outside of a center of the gear pump.

9. The pump unit according to claim 7, further comprising a baffle disposed in the central transverse bore between the pressure bore in the discharge space and the pressure bore in the gear pump.

10. The pump unit according to claim 9, further comprising a pressure filter, the pressure filter including the baffle.

11. A pump unit, comprising:

a housing;

a gear pump integrated into the housing;

a drive connected to the gear pump;

a discharge space extending radially to an outer limit of a pressure field of the gear pump and extending axially an entire length of the housing;

an intake space extending axially the entire length of the housing, the gear pump being surrounded by the discharge space and the intake space;

an oil feed; and an oil drain;

wherein the discharge space includes ribs arranged for pulsation damping and pressure field stabilization;

the pump unit further comprising a clutch, the gear pump including a drive shaft, the clutch being disposed between the drive shaft of the gear pump and the drive.

12. The pump unit according to claim 11, wherein the clutch is a loss-proof clutch.

13. A pump unit, comprising:

a housing;

a gear pump integrated into the housing;

a drive connected to the gear pump;

a discharge space extending radially to an outer limit of a pressure field of the gear pump and extending axially an entire length of the housing, the discharge space including ribs configured to damp pulsations and to stabilize a pressure field;

an intake space extending axially the entire length of the housing, the gear pump surrounded by the discharge space and the intake space;

an oil feed; and an oil drain.

14. The pump unit according to claim 13, wherein the pump unit includes a power steering pump for a drive unit of a motor vehicle.

15. The pump unit according to claim 13, further comprising a cover, a filter cap and a filter space disposed between the cover and the filter cap.

16. The pump unit according to claim 15, further comprising a feeder valve for the discharge space in fluid communication with the filter space.

17. The pump unit according to claim 15, wherein the cover includes a pressure limiting valve.

18. The pump unit according to claim 13, wherein the oil feed is in fluid communication with an oil tank.

19. The pump unit according to claim 13, wherein a central transverse bore having pressure bores in the discharge space is arranged coaxially in the gear pump.

20. The pump unit according to claim 19, wherein the central transverse bore includes a coaxial intake bore disposed at a level of a gland located outside of a center of the gear pump.

21. The pump unit according to claim 19, further comprising a baffle disposed in the central transverse bore between the pressure bore in the discharge space and the pressure bore in the gear pump.

22. The pump unit according to claim 21, further comprising a pressure filter including the baffle.

23. The pump unit according to claim 13, further comprising a clutch, the gear pump including a drive shaft, the clutch disposed between the drive shaft of the gear pump and the drive.

24. The pump unit according to claim 23, wherein the clutch includes a loss-proof clutch.

* * * * *

UNITED STATES PATENT AND TRADEMARK OFFICE

CERTIFICATE OF CORRECTION

PATENT NO. : 6,506,029 B1 
DATED : January 14, 2003
INVENTOR(S) : Michael Reichenmiller It is certified that error appears in the above-identified patent and that said Letters Patent is hereby corrected as shown below:

Title page,
Item [57], ABSTRACT,
Line 4, change "housing Ribs" to -- housing. Ribs --;

Column 2,
Line 32, change "so, that" to -- so that --.

Signed and Sealed this

Eleventh Day of November, 2003

JAMES E. ROGAN
*Director of the United States Patent and Trademark Office*